US010190378B2

(12) United States Patent
Alajbegovic et al.

(10) Patent No.: US 10,190,378 B2
(45) Date of Patent: Jan. 29, 2019

(54) DRILLING HEAD WITH NON-ROTATING ANNULAR SEAL ASSEMBLY

(71) Applicant: WEATHERFORD TECHNOLOGY HOLDINGS, LLC, Houston, TX (US)

(72) Inventors: Vahidin Alajbegovic, Cypress, TX (US); Lev Ring, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 134 days.

(21) Appl. No.: 15/221,940

(22) Filed: Jul. 28, 2016

(65) Prior Publication Data

US 2018/0030799 A1 Feb. 1, 2018

(51) Int. Cl.
*E21B 33/03* (2006.01)
*E21B 33/06* (2006.01)
*E21B 33/08* (2006.01)

(52) U.S. Cl.
CPC ..... *E21B 33/03* (2013.01); *E21B 33/06* (2013.01); *E21B 33/08* (2013.01)

(58) Field of Classification Search
CPC ..... E21B 33/03
USPC ..... 166/379
See application file for complete search history.

(56) References Cited

U.S. PATENT DOCUMENTS 4,759,530 A * 7/1988 Iff ..... F16K 1/2265 251/214
2001/0047885 A1 12/2001 Calder
2010/0218937 A1 9/2010 Edvardsen et al.
2011/0315404 A1* 12/2011 Bailey ..... E21B 21/015 166/387
2013/0168578 A1 7/2013 Leuchtenberg et al.
2014/0027129 A1 1/2014 Hannegan et al.
2015/0075804 A1 3/2015 Orbell et al.
2015/0144400 A1 5/2015 Leuchtenberg et al.
2015/0369000 A1 12/2015 Leuchtenberg et al.

FOREIGN PATENT DOCUMENTS

WO 2013102131 A2 7/2013

OTHER PUBLICATIONS

Specification and drawings for PCT Patent Application No. PCT/US17/39644, filed Jun. 28, 2017, 52 pages.
International Search Report with Written Opinion dated Oct. 30, 2017 for PCT Patent Application No. PCT/US2017/039745, 17 pages.

* cited by examiner

*Primary Examiner* — Taras P Bemko
(74) *Attorney, Agent, or Firm* — Smith IP Services, P.C.

(57) ABSTRACT

A drilling head can include an annular seal assembly releasably secured in an outer housing, the annular seal assembly including an annular seal and an actuator that pressurizes a lubricant for delivery to an interior of the annular seal. A method can include positioning an annular seal in a drilling head, the annular seal including an inner liner having openings formed through a sidewall of the inner liner, and flowing a lubricant into an opening while the inner liner sealingly engages a tubular. In another method, the annular seal can have a minimum inner diameter for sealing engagement with a tubular, and a lubricant passage extending through the annular seal and intersecting an interior of the annular seal at a location spaced apart from the minimum inner diameter. A lubricant is flowed through the lubricant passage to the interior of the annular seal.

18 Claims, 10 Drawing Sheets

DRILLING HEAD WITH NON-ROTATING ANNULAR SEAL ASSEMBLY

BACKGROUND

This disclosure relates generally to equipment utilized and operations performed in conjunction with a subterranean well and, in an example described below, more particularly provides a drilling head with a non-rotating annular seal assembly.

A drilling head is typically used to seal off an annular space surrounding a drill string. Sealing off the annular space can be useful in certain types of drilling operations (such as, managed pressure drilling, including underbalanced drilling), in which a well annulus is pressure isolated from atmosphere at surface.

It will, therefore, be appreciated that improvements are continually needed in the arts of designing, constructing and utilizing drilling heads. Such improvements may be useful in managed pressure drilling operations, or in other well operations, whether or not the operations include drilling.

DETAILED DESCRIPTION

Figure 1:
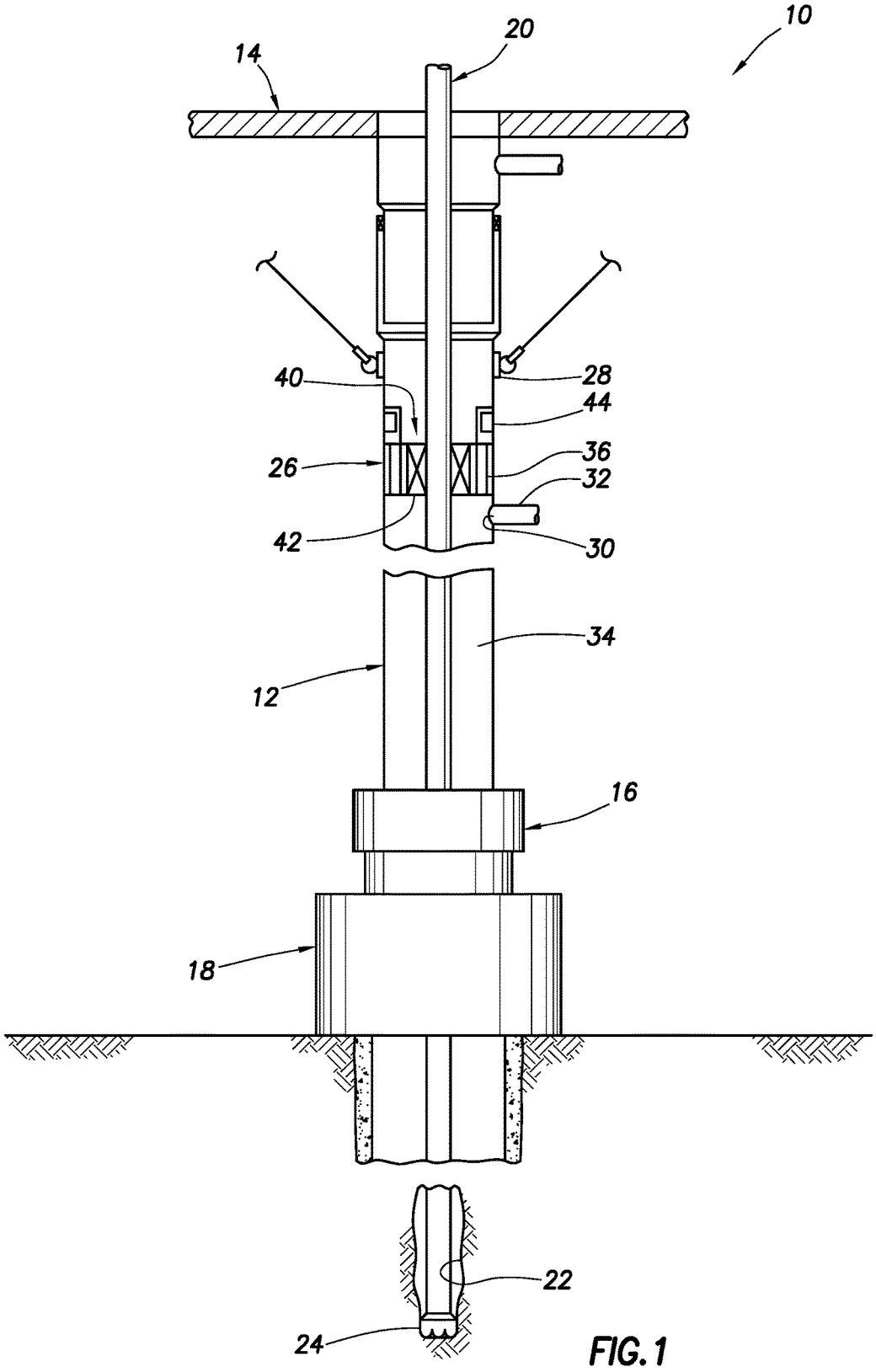
FIG. 1 is a representative partially cross-sectional view of an example of a well system and associated method which can embody principles of this disclosure.

Representatively illustrated in FIG. 1 is a well system 10 and associated method, which system 10 and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10 as depicted in FIG. 1, a generally tubular riser string 12 extends between a water-based rig 14 and a lower marine riser package 16 above a subsea wellhead installation 18 (including, for example, various blowout preventers, hangers, fluid connections, etc.). However, in other examples, the principles of this disclosure could be practiced with a land-based rig, or with a riser-less installation.

In the FIG. 1 example, a tubular string 20 (such as, a jointed or continuous drill string, a coiled tubing string, etc.) extends through the riser string 12 and is used to drill a wellbore 22 into the earth. For this purpose, a drill bit 24 is connected at a distal end of the tubular string 20.

The drill bit 24 may be rotated by rotating the tubular string 20 (for example, using a top drive or rotary table of the rig 14), and/or a drilling motor (not shown) may be connected in the tubular string 20 above the drill bit 24.

Furthermore, the principles of this disclosure could be utilized in well operations other than drilling operations (such as, well testing, stimulation, conformance, water or gas flooding, production operations, etc.). Thus, it should be appreciated that the scope of this disclosure is not limited to any of the details of the tubular string 20 or wellbore 22 as depicted in the drawings or as described herein.

The riser string 12 depicted in FIG. 1 includes a drilling head 26 connected in the riser string below a tensioner ring 28. In other examples, the drilling head 26 could be connected above the tensioner ring 28, or could be otherwise positioned (such as, in the wellhead installation 18 in a riser-less configuration). Thus, the scope of this disclosure is not limited to any particular details of the riser string 12 or drilling head 26 as described herein or depicted in the drawings.

The drilling head 26 includes a side port 30 that provides for fluid communication between a conduit 32 and an annulus 34 formed radially between the riser string 12 and the tubular string 20. In a typical drilling operation, drilling fluid can be circulated from the rig 14 downward through the tubular string 20, outward from the drill bit 24, upward through the annulus 34, and return to the rig 14 via the conduit 32.

As depicted in FIG. 1, an annular seal assembly 40 is installed in the drilling head 26. The annular seal assembly 40 includes one or more annular seals 42 that seal off the annulus 34 above the side port 30.

In this example, the annular seal(s) 42 are configured to sealingly engage an exterior of the tubular string 20. The annular seal(s) 42 may be of a type known to those skilled in the art as "passive," "active" or a combination of passive and active. The scope of this disclosure is not limited to use of any particular type of annular seal.

The annular seal assembly 40 is releasably secured in the drilling head 26 by a latch assembly 44. The latch assembly 44 permits the annular seal assembly 40 to be installed in, or retrieved from, the drilling head 26 when desired, for example, to service or replace the annular seal(s) 42 and/or a lubricant supply 36.

Figure 2:
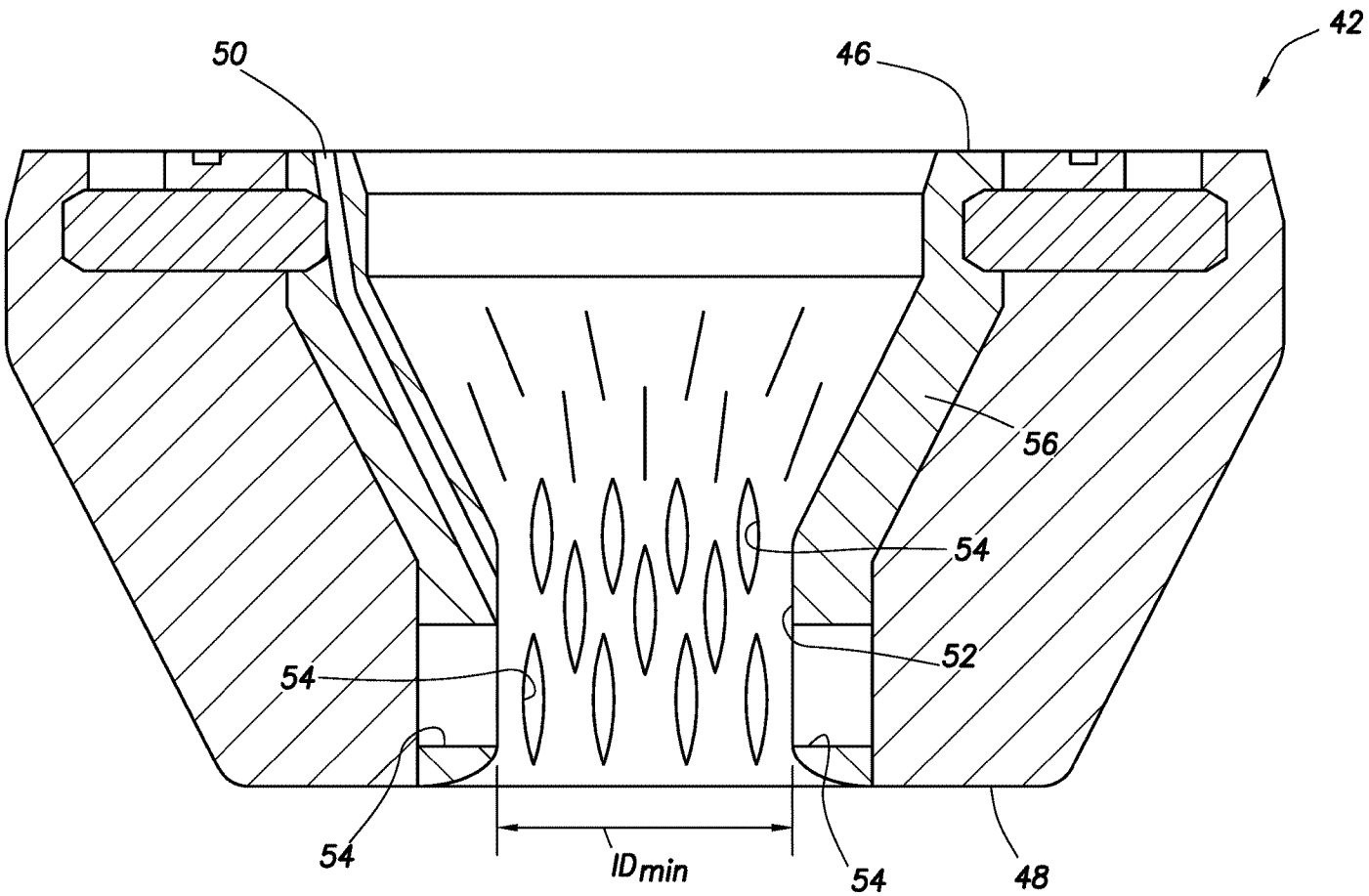
FIG. 2 is a representative cross-sectional view of an example of an annular seal that may be used in the system and method of FIG. 1, and which can embody the principles of this disclosure.

Referring additionally now to FIG. 2, an example of the annular seal 42 is representatively illustrated, apart from the remainder of the system 10, drilling head 26 and annular seal assembly 40 of FIG. 1. The annular seal 42 of FIG. 2 may be used in other methods, systems, drilling heads and annular seal assemblies, in keeping with the principles of this disclosure.

In this example, the annular seal 42 includes an inner liner 46 and an outer body 48 surrounding the inner liner 46. The outer body 48 provides elasticity and resilience to maintain the inner liner 46 in sealing contact with a tubular (such as, the tubular string 20 of FIG. 1, a protective sleeve, etc.) received in the annular seal 42.

The inner liner 46 may be made of a relatively tough, low friction, hard, strong, wear resistant, high temperature resistant, hydrocarbon resistant and/or fatigue resistant material. The material may be selected for its suitability in withstanding relative rotation between the tubular and the inner liner 46, displacement of the tubular longitudinally through the inner liner 46, and a pressure differential across the annular seal 42, all of which may occur simultaneously or separately.

Suitable materials for use in the inner liner 46 may include plastics, such as nylons, poly-ether-ether-ketone (PEEK), poly-tetra-fluoro-ethylene (PTFE), acetals, etc. Composite materials and other combinations of materials may be used in some examples. However, the scope of this disclosure is not limited to use of any particular material(s) in the inner liner 46.

Instead of, or in addition to, forming the inner liner 46 of a low friction material, a coating or layer comprising a low friction material could be formed, molded, applied, bonded or otherwise affixed to an interior surface of the inner liner 46. Suitable low friction materials may include PTFE, nano-composites, molybdenum disulfide, tungsten disulfide, acetals, other low friction polymers, etc. The material(s) may be layered over the inner liner 46 substrate, or may be diffused into the substrate during manufacturing for additional durability.

The outer body 48 may be made of an elastomeric material, or another material with substantial elasticity. Examples of suitable materials may include nitriles, fluorocarbon elastomers (such as VITON™), silicone elastomers, etc. The scope of this disclosure is not limited to use of any particular material in the outer body 48.

In the FIG. 2 example, a lubricant passage 50 extends through the inner liner 46 to an interior of the inner liner 46. As depicted in FIG. 2, the lubricant passage 50 intersects the interior of the inner liner 46 at a minimum inner diameter IDmin of the inner liner 46.

The tubular will sealingly contact the inner liner 46 at the minimum inner diameter IDmin. The lubricant passage 50 can deliver a lubricant to a sealing surface 52 of the inner liner 46 at the minimum inner diameter IDmin, and thereby reduce friction due to relative displacement (rotational and longitudinal) between the tubular and the inner liner 46.

Although the inner liner 46 may not possess substantial elasticity in some examples, the inner liner 46 can still expand and retract radially (e.g., to allow for displacement of a radially enlarged tool joint or collar through the annular seal 42) if it has sufficient flexibility. The flexibility of the inner liner 46 can be enhanced by providing openings 54 formed through a sidewall 56 of the inner liner 46. The openings 54 can provide for greater diameter changes, while reducing a level of strain in the material of the inner liner 46.

Figure 3:
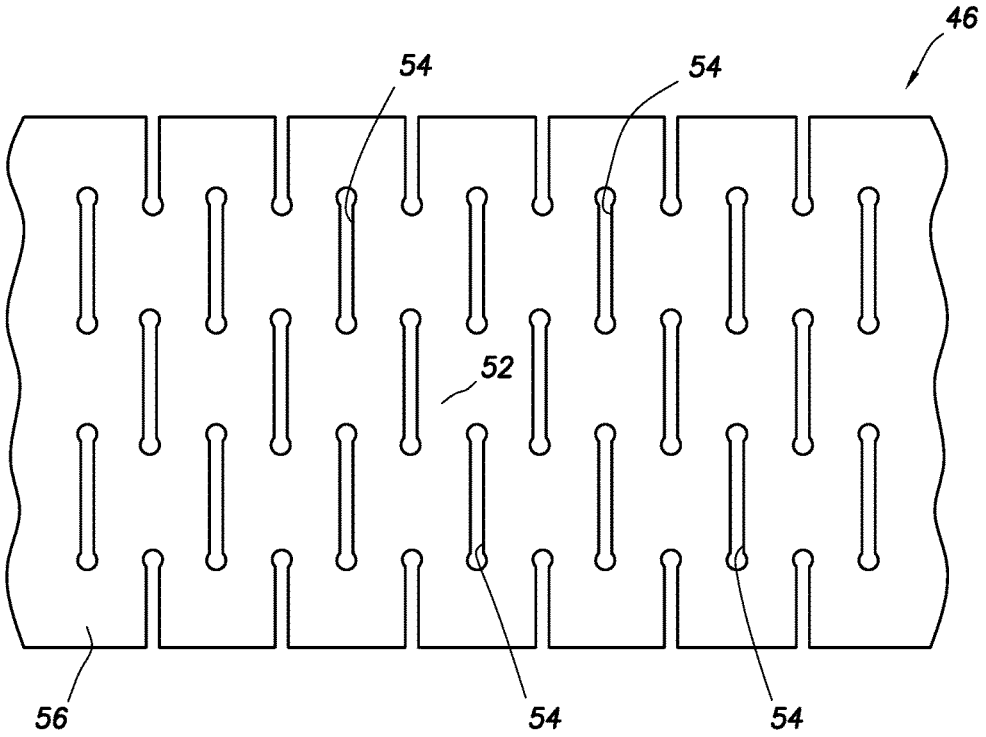
FIGS. 3 & 4 are representative elevational views of an example of an inner liner of the annular seal in respective unexpanded and expanded configurations.
Figure 4:
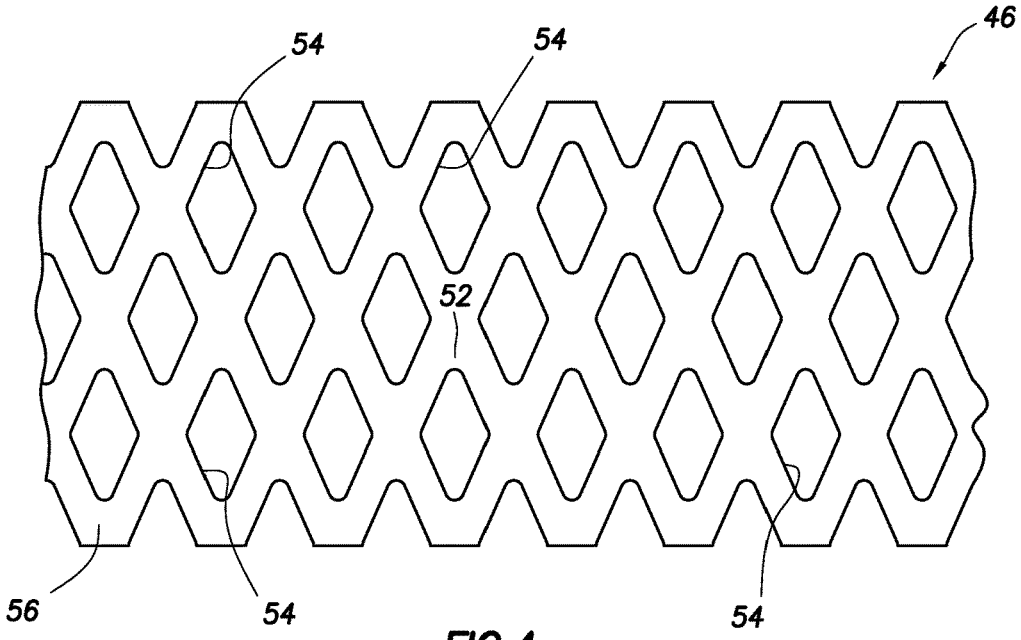

Referring additionally now to FIGS. 3 & 4, an example of one way in which the flexibility of the inner liner 46 may be enhanced is representatively illustrated. The inner liner 46 is depicted in FIGS. 3 & 4 as if it is "unrolled" from its tubular form to a flattened form.

In FIG. 3, the inner liner 46 is in an initial unexpanded configuration. The openings 54 are formed as slots or slits extending through the sidewall 56 of the inner liner 46.

In FIG. 4, the inner liner 46 is in an expanded configuration, in which it is laterally stretched. The openings 54 have spread open in the lateral direction, so that they now have a substantially diamond shape. Such lateral stretching, when the inner liner 46 is in its tubular form, will correspond to radial expansion of the inner liner 46.

Note that rows of the openings 54 in the inner liner 46 are spaced apart, so that the inner liner 46 can effectively maintain sealing contact with the tubular. That is, a continuous leak path does not exist longitudinally across the sealing surface 52 of the inner liner 46. Instead, the sealing surface 52 is circumferentially continuous, when the inner liner 46 is in its tubular form.

In some examples, the lubricant passage 50 (see FIG. 2) may extend through the sidewall 56 to one or more of the openings 54. In this manner, a lubricant may be conveniently delivered to the sealing surface 52 via the lubricant passage 50 and opening(s) 54.

Figure 5:
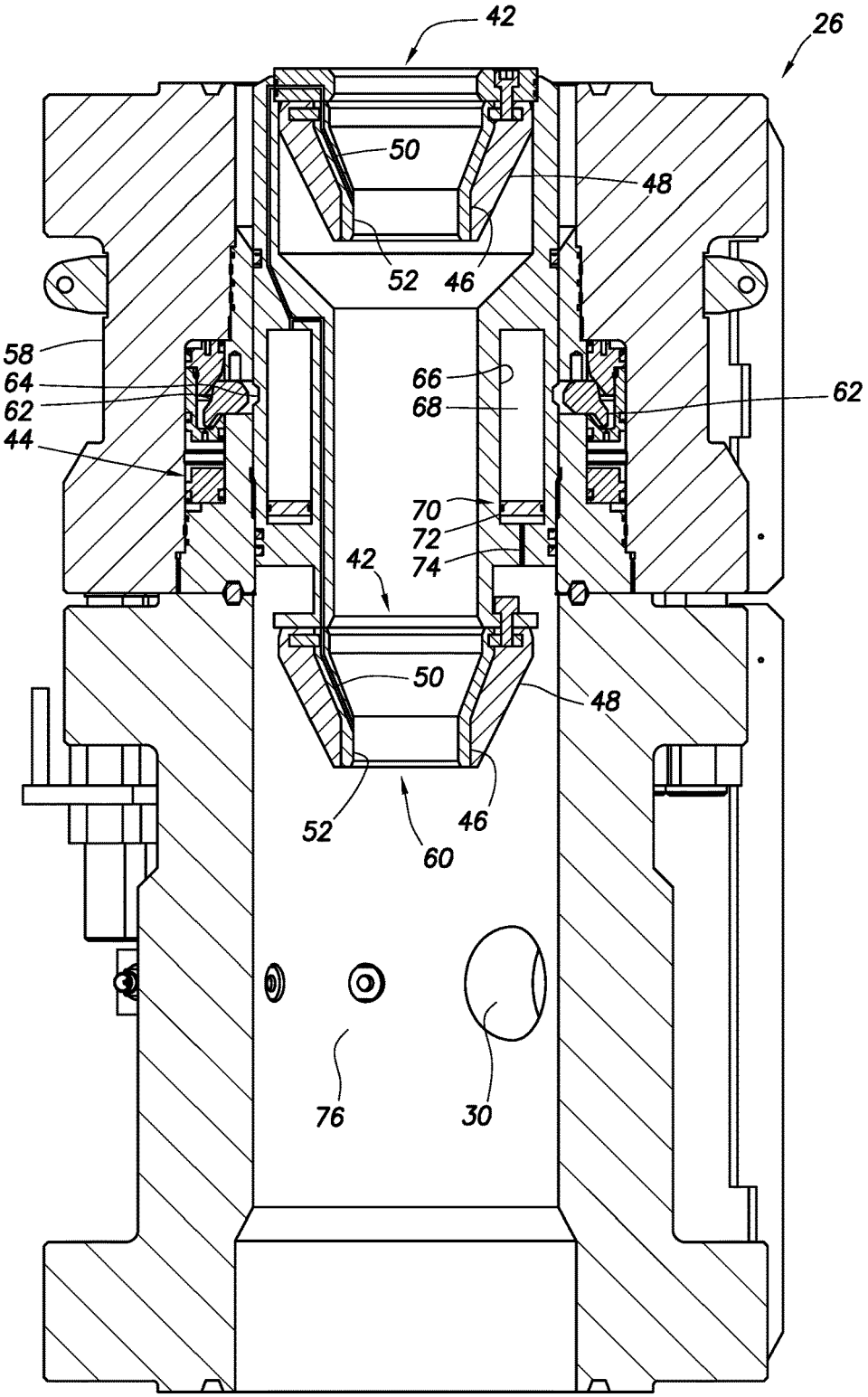
FIG. 5 is a representative cross-sectional view of an example of a drilling head that may incorporate the annular seal therein, and which can embody the principles of this disclosure.

Referring additionally now to FIG. 5, a cross-sectional view of an example of the drilling head 26 is representatively illustrated. The drilling head 26 of FIG. 5 is configured for use with a land-based rig, instead of the water-based rig 14 of the FIG. 1 system 10 and method. However, the drilling head 26 could be configured for use with the water-based rig 14 in some examples (such as, by providing upper and lower flanged connections, etc.).

In the FIG. 5 example, an annular seal assembly 60 is releasably securable in an outer housing 58 of the drilling head 26. The annular seal assembly 60 may be used for the annular seal assembly 40 in the FIG. 1 system 10 and method, or it may be used with other systems or methods.

The latch assembly 44, in this example, includes radially extendable and retractable keys or dogs 62 that can engage an external profile 64 on the annular seal assembly 60. Such engagement can prevent longitudinal and rotational displacement of the annular seal assembly 60 relative to the outer housing 58.

In other examples, separate latches, keys or other engagement devices may be used to releasably secure the annular seal assembly 60 against longitudinal and rotational displacement relative to the outer housing 58. In further examples, the latch assembly 44 could be incorporated into the annular seal assembly 60, in which case the profile 64 could be formed in the outer housing 58. Thus, it will be appreciated that the scope of this disclosure is not limited to any particular details of the drilling head 26 and annular seal assembly 60 described herein or depicted in the drawings.

In the FIG. 5 example, the annular seal assembly 60 includes two of the FIG. 2 annular seals 42. However, the annular seals 42 depicted in FIG. 5 do not include the openings 54 in the inner liners 46. The openings 54 could be provided in the FIG. 5 example, if desired, to enhance the flexibility of the inner liners 46.

The annular seal assembly 60 of FIG. 5 includes a lubricant reservoir 66 for containing a lubricant 68. The annular seal assembly 60 also includes an actuator 70 for pressurizing the lubricant reservoir 66, so that the lubricant 68 is flowed to the lubricant passages 50 in the annular seals 42. The lubricant reservoir 66 and actuator 70 may be used for the lubricant supply 36 in the FIG. 1 system 10 and method.

In this example, the actuator 70 includes an annular floating piston 72 and a passage 74 providing fluid communication between a lower side of the piston 72 and an interior 76 of the outer housing 58 below the annular seals 42. When a tubular is sealingly received in the annular seals 42, pressure in the interior 76 of the outer housing 58 below the annular seals 42 will typically be greater than pressure above the annular seals 42, and so the floating piston 72 will be biased upward (as viewed in FIG. 5), and will thereby pressurize the lubricant reservoir 66.

Although the lubricant reservoir 66 is pressurized by the actuator 70 to a level substantially equal to the pressure in the interior 76 of the outer housing 58 below the annular seals 42 in the FIG. 5 example, the lubricant reservoir 66 may be otherwise pressurized in other examples. Additional examples are described below, but it should be understood that the scope of this disclosure is not limited to any particular level of pressurization, to any particular means for pressurizing the lubricant 68, or to pressurizing the lubricant reservoir 66 at all.

Note that the annular seals 42, the lubricant reservoir 66 and the actuator 70 are all incorporated into the annular seal assembly 60 in the FIG. 5 example, and so all of these elements can be conveniently installed in the drilling head 26 and retrieved from the drilling head 26 together. In other examples, other, additional, fewer or different combinations of elements may be incorporated into the annular seal assembly 60.

Figure 6:
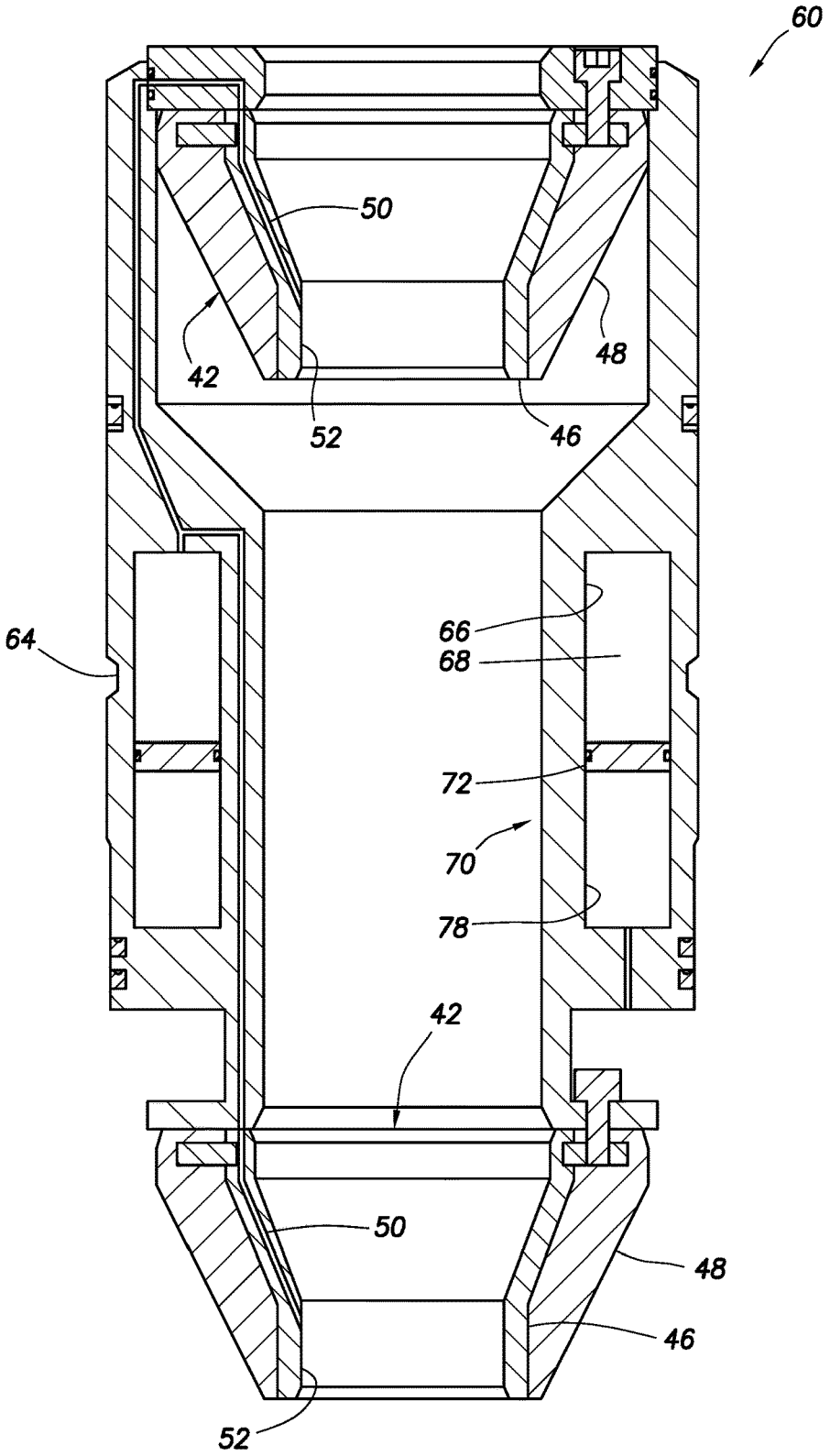
FIG. 6 is a representative cross-sectional view of an example of an annular seal assembly that may be used in the drilling head.

Referring additionally now to FIG. 6, another example of the annular seal assembly 60 is representatively illustrated. The FIG. 6 annular seal assembly 60 may be used in the FIG. 5 drilling head 26, or it may be used in other drilling heads (such as, a drilling head configured for use with the water-based rig 14 of FIG. 1).

In the FIG. 6 example, the actuator 70 includes the floating piston 72. However, instead of the passage 74 of the FIG. 5 example for applying pressure to a lower side of the piston 72, the FIG. 6 example includes a pressurized gas chamber 78. For example, the chamber 78 could contain nitrogen gas or another inert gas at an elevated pressure.

The floating piston 72 and the pressurized gas chamber 78 can be considered an accumulator in the FIG. 6 example. Other types of accumulators that may be used include bladder or membrane-type accumulators. Valves and other pressure and flow control devices (not shown) may be included in the FIG. 6 annular seal assembly 60 for purging, filling, pressurizing and actuating the accumulator.

Figure 7:
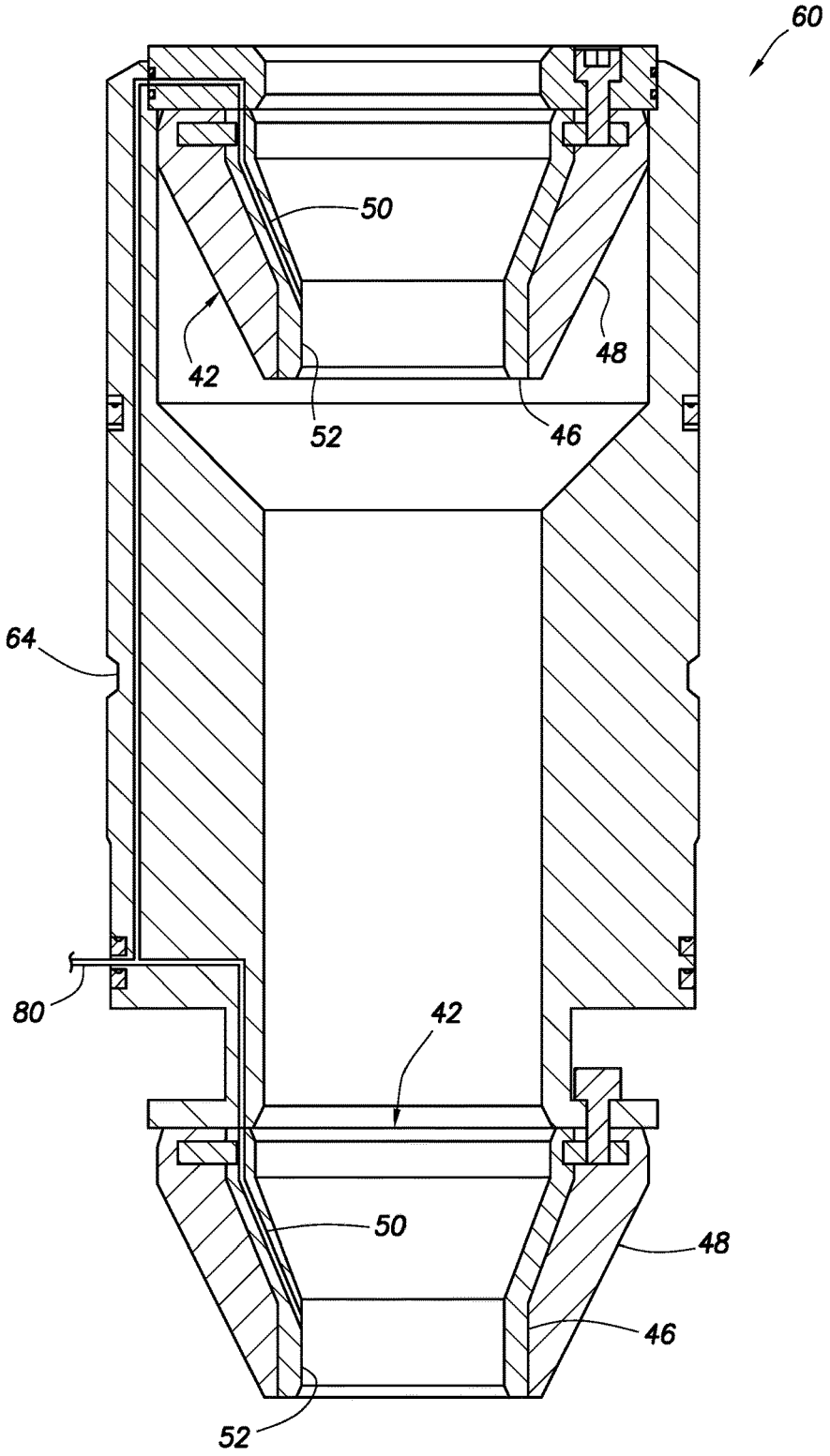
FIG. 7 is a representative cross-sectional view of another example of the annular seal assembly.

Referring additionally now to FIG. 7, another example of the annular seal assembly 60 is representatively illustrated. In this example, the annular seal assembly 60 does not include the actuator 70.

Instead, the lubricant 68 is delivered to the lubricant passages 50 via an external line 80. The external line 80 could be located in the outer housing 58 (see FIG. 5), and could be supplied with pressurized lubricant 68 from a source internal to, or external to, the outer housing 58 (such as, a pump in the outer housing 58 or on the FIG. 1 rig 14).

Figure 8:
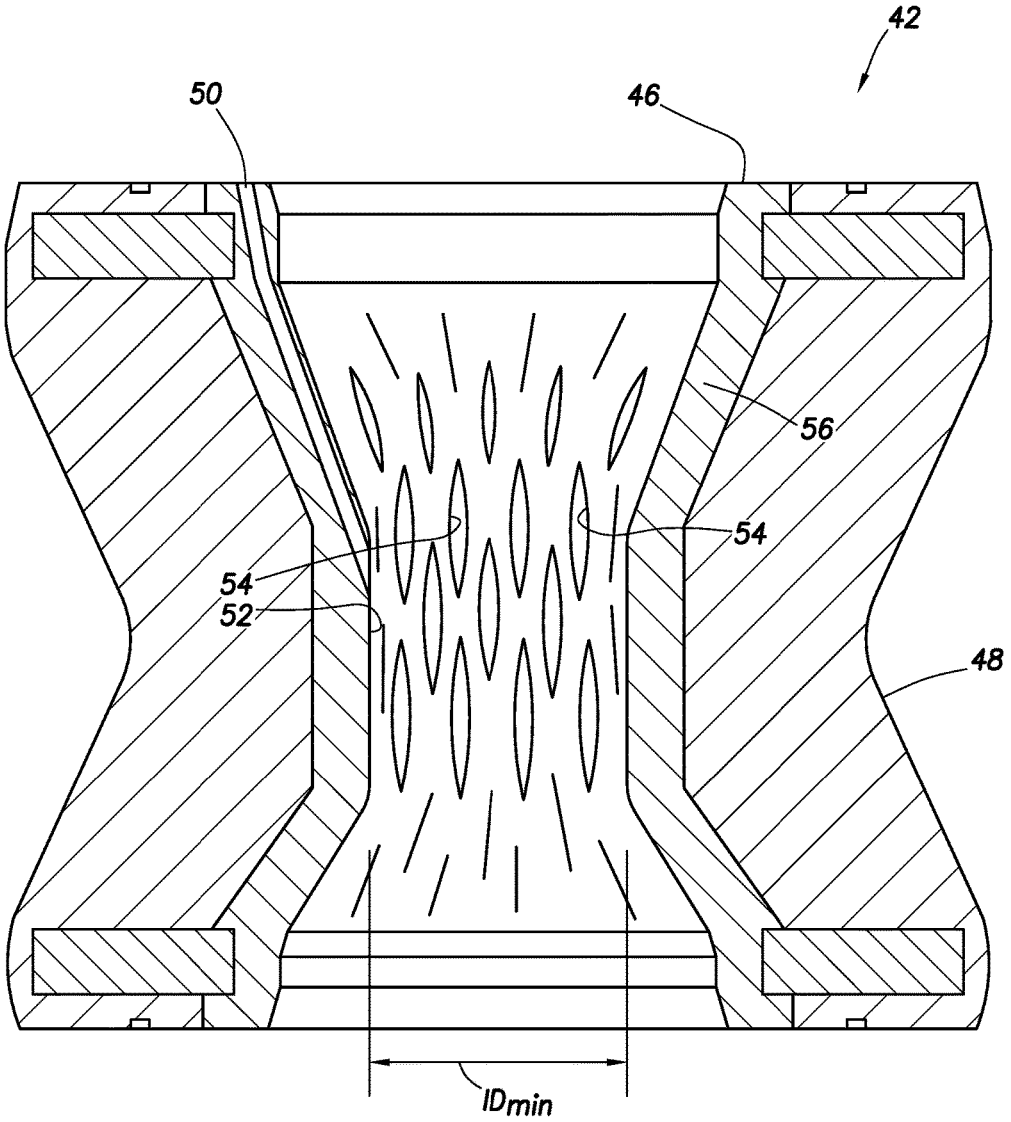
FIG. 8 is a representative cross-sectional view of another example of the annular seal.

Referring additionally now to FIG. 8, another example of the annular seal 42 is representatively illustrated. This example is similar in many respects to the example of FIG. 2, so the same reference numbers are used to indicate similar elements in FIG. 8.

The FIG. 8 annular seal 42 may be an active seal. In some examples, the sealing surface 52 of the annular seal 42 could be biased radially inward into sealing engagement with a tubular therein by applying elevated pressure to an exterior of the outer body 48.

In other examples, the sealing surface 52 of the annular seal 42 could be deflected radially inward into sealing engagement with a tubular therein by axially (longitudinally) compressing the annular seal. Thus, the scope of this disclosure is not limited to any particular technique for actuating an active annular seal.

Note that it is not necessary for the FIG. 8 annular seal 42 to be an active seal. In some examples, the FIG. 8 annular seal 42 could be a passive seal (e.g., having a minimum inner diameter IDmin that is continually less than an outer diameter of a tubular to be sealed against, unless the tubular is positioned in the annular seal 42).

Figure 9:
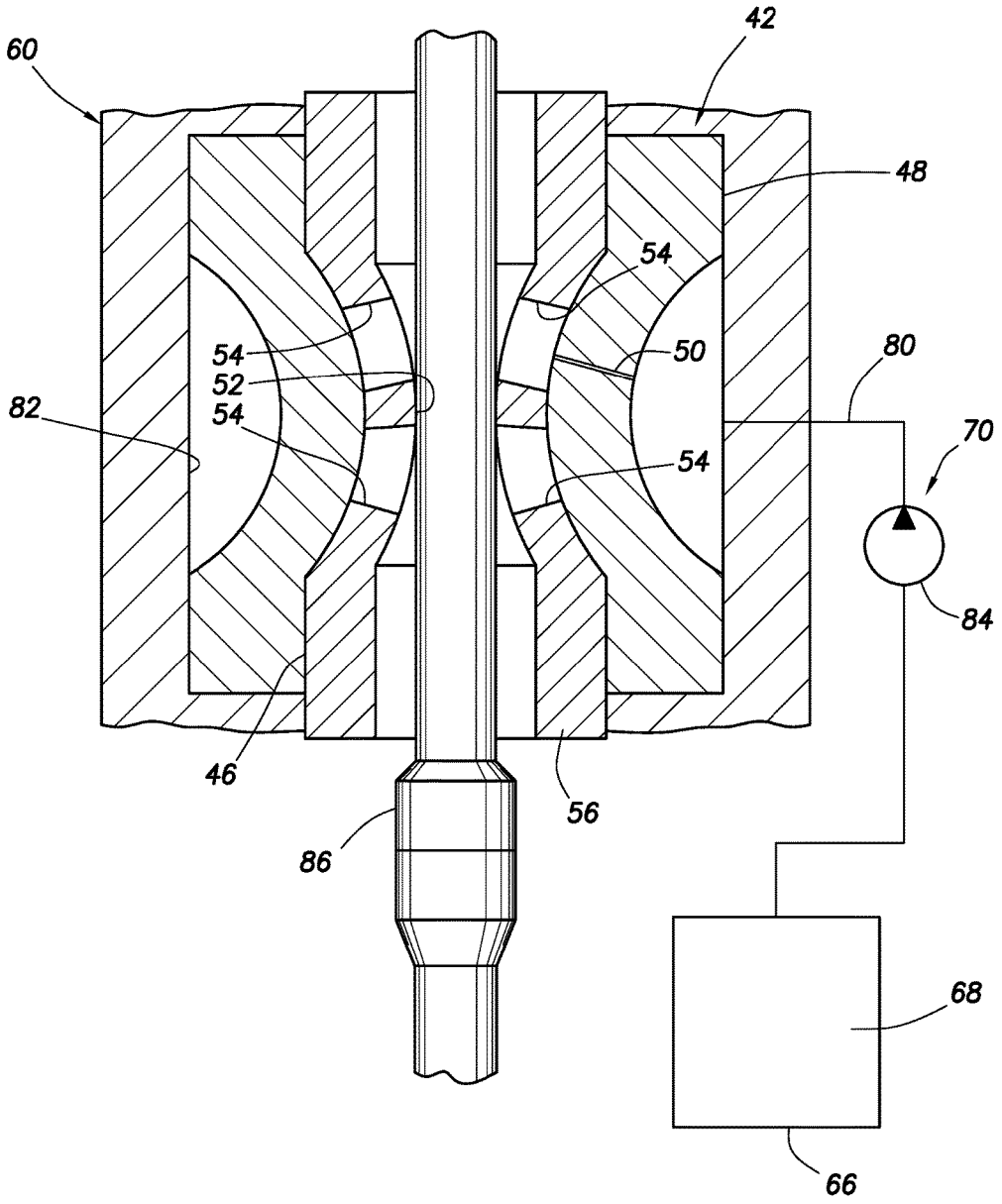
FIG. 9 is a representative cross-sectional view of yet another example of the annular seal.

Referring additionally now to FIG. 9, another example of the annular seal 42 in a portion of the annular seal assembly 60 is representatively illustrated. The annular seal 42 is installed in the annular seal assembly 60, so that a chamber 82 is formed external to the outer body 48.

The actuator 70 delivers pressurized lubricant 68 from the reservoir 66 to the chamber 82. In the FIG. 9 example, the actuator 70 includes a pump 84. The actuator 70 and the lubricant reservoir 66 may be incorporated into the annular seal assembly 60, or into the outer housing 58 of the drilling head 26 (see FIG. 5), or the actuator 70 and the lubricant reservoir 66 may be external to the drilling head 26.

The pressurized lubricant 68 in the chamber 82 may cause the sealing surface 52 of the annular seal 42 to extend radially inward into contact with a tubular 86 extending longitudinally through the annular seal 42. The pressurized lubricant 68 may also be delivered to the sealing surface 52 via the lubricant passage 50 and one or more of the openings 54 in the inner liner 46. The lubricant passage 50 may extend between the chamber 82 and the opening(s) 54 through the outer body 48 as depicted in FIG. 9, or the lubricant passage 50 could extend through the sidewall 56 of the inner liner 46 as in the examples of FIGS. 2-8.

Figure 10:
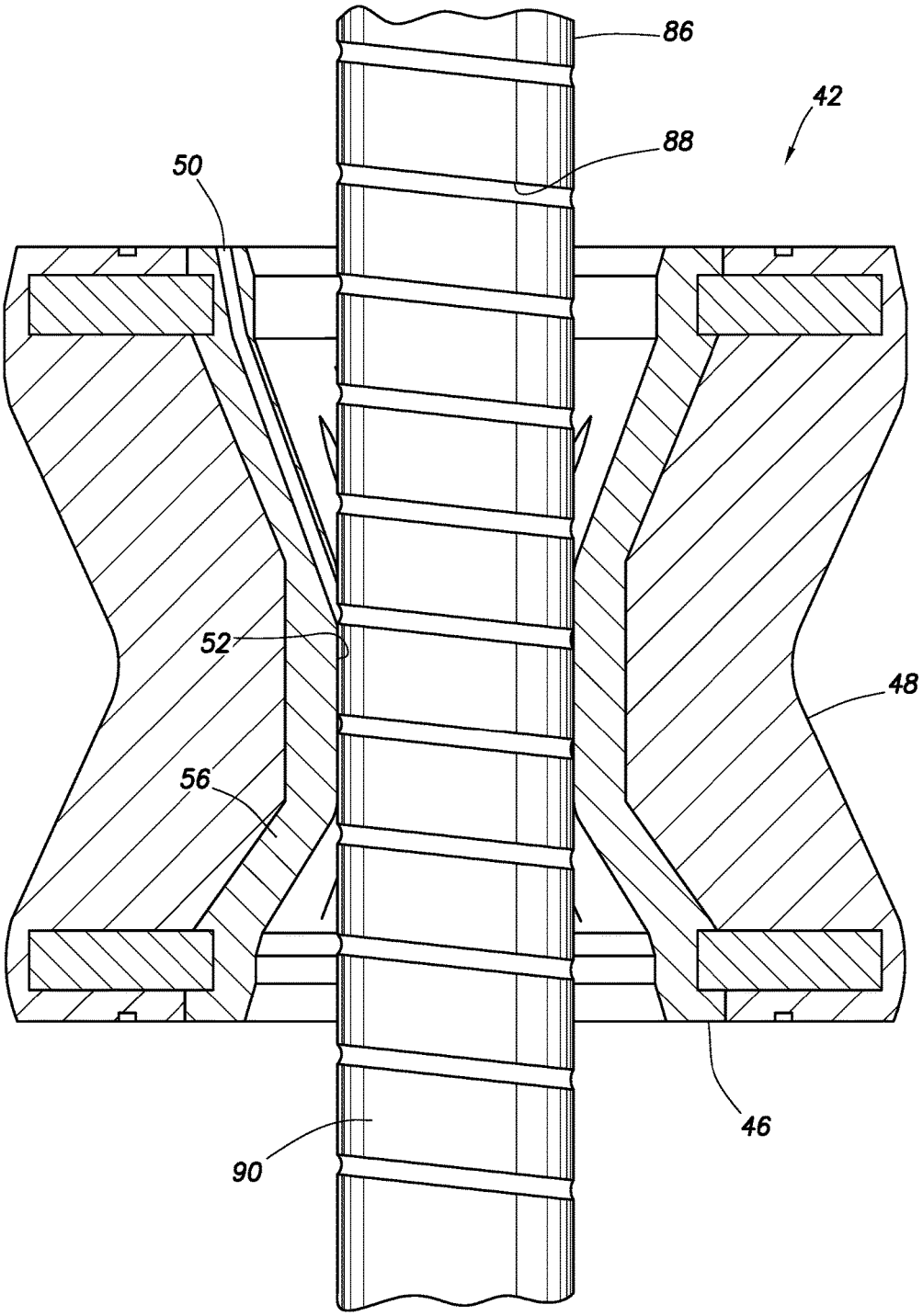
FIG. 10 is a representative partially cross-sectional view of a method of distributing a lubricant between the annular seal and a tubular therein.

Referring additionally now to FIG. 10, another example of the annular seal 42 is representatively illustrated, with the tubular 86 therein. In this example, the lubricant passage 50 does not intersect the sealing surface 52 of the inner liner 46.

Instead, the lubricant passage 50 intersects the interior of the inner liner 46 at a location above the sealing surface 52 (as viewed in FIG. 10). In this manner, the lubricant 68 in the passage 50 does not have to be pressurized to greater than a contact pressure between the tubular 86 and the sealing surface 52, in order for the lubricant 68 to flow from the lubricant passage 50.

In the FIG. 10 example, the tubular 86 has one or more external helical profiles 88 formed thereon. As the tubular 86 rotates in the annular seal 42, the helical profiles 88 convey the lubricant 68 (delivered to the interior of the inner liner 46 via the lubricant passage 50) to the sealing surface 52, so that an interface between the sealing surface 52 and an exterior surface 90 of the tubular 86 is lubricated. The helical profiles 88 can also convey the lubricant 68 to the interface between the sealing surface 52 and the exterior surface 90 as the tubular 86 is displaced longitudinally downward (as viewed in FIG. 10) relative to the annular seal 42.

Figure 11:
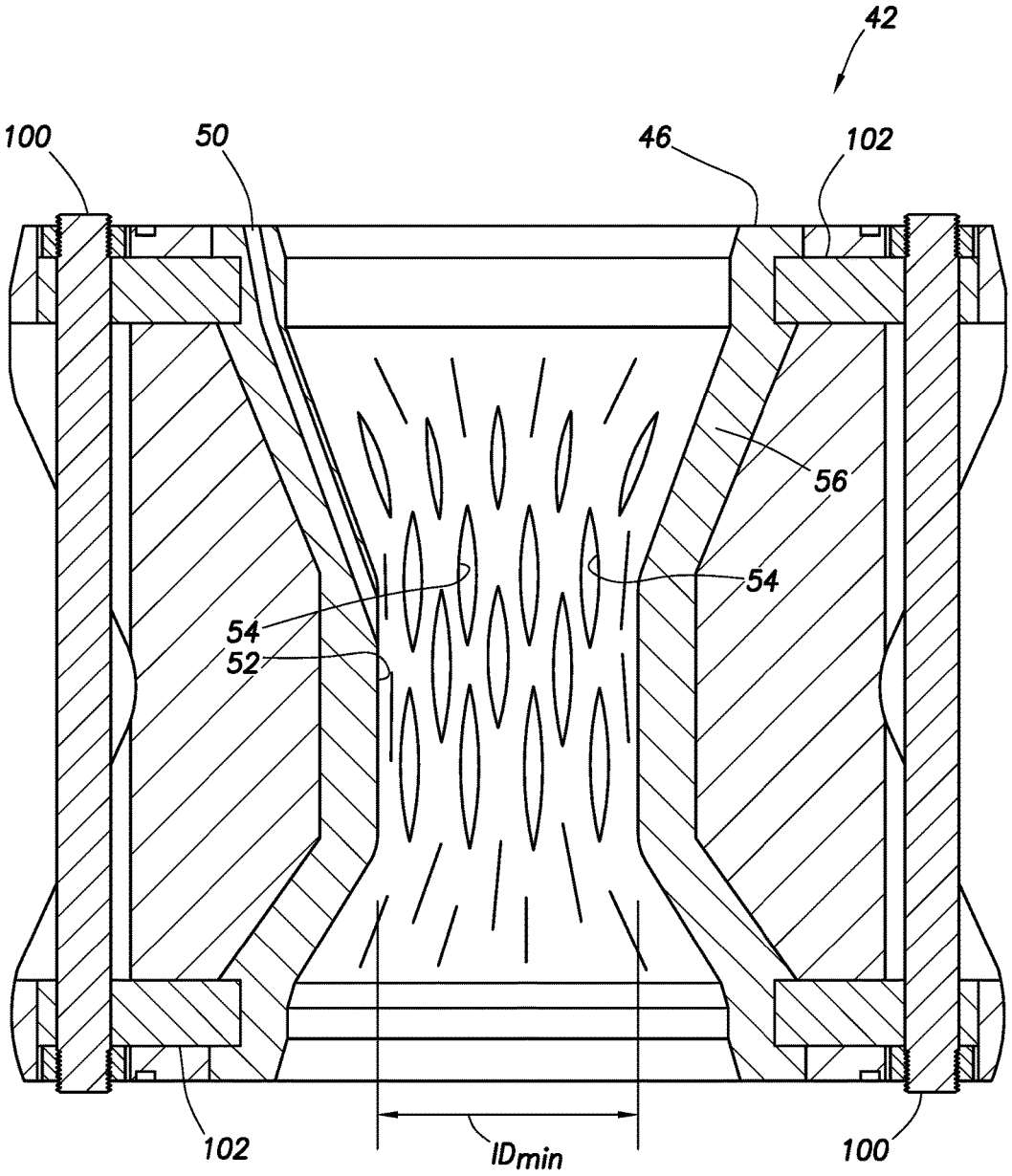
FIG. 11 is a representative cross-sectional view of another example of the annular seal.

Referring additionally now to FIG. 11, another example of the annular seal 42 is representatively illustrated. This example is similar in many respects to the FIG. 8 example.

In the FIG. 11 example, the annular seal 42 is longitudinally or axially restrained and supported by multiple support structures or retainers 100 that extend between support rings 102. The support rings 102 in this example are molded, embedded in, or otherwise affixed at opposite longitudinal ends of the outer body 48 and inner liner 46. The retainers 100 are depicted in FIG. 11 as being externally threaded rods or bolts, but other types of support structures may be used in other examples.

The retainers 100 constrain axial or longitudinal deformation of the inner liner 46 and outer body 48. In other examples, axial or longitudinal deformation could be constrained or limited by use of other structures, such as, a rigid outer shell or enclosure, etc.

It may now be fully appreciated that the above disclosure provides significant advancements to the arts of designing, constructing and utilizing drilling heads for use with subterranean wells. In various examples described above, an annular seal 42 can include an inner liner 46 that is uniquely configured for sealingly engaging a tubular 86 that displaces relative to the annular seal 42. An annular seal assembly 60 can be conveniently installed and retrieved along with a lubricant reservoir 66 and/or an actuator 70.

A drilling head 26 for use with a subterranean well is provided to the art by the above disclosure. In one example, the drilling head 26 can include an outer housing 58 and an annular seal assembly 60 releasably secured in the outer housing 58. The annular seal assembly 60 can include at least one annular seal 42 and an actuator 70 that pressurizes a lubricant 68 for delivery to an interior of the annular seal 42.

The actuator 70 may be in fluid communication with a lubricant passage 50 extending through an inner liner 46 of the annular seal 42.

The annular seal 42 may include an inner liner 46 surrounded by an outer body 48. The inner liner 46 may comprise a plastic material, and the outer body 48 may comprise an elastomeric material.

Multiple openings 54 may be formed through a sidewall 56 of the inner liner 46. A lubricant passage 50 may be in fluid communication with at least one of the openings 54.

A lubricant passage 50 may extend through the inner liner 46 and intersect the interior of the annular seal 42 at a location spaced apart from a minimum inner diameter IDmin of the inner liner 46. A tubular 86 may be sealingly engaged by the inner liner 46 and extend longitudinally through the inner liner 46, with the tubular 86 having an external helical profile 88 adjacent the location.

The actuator 70 may comprise a pump 84 and/or an accumulator (for example, the floating piston 72 and pressurized gas chamber 78).

The actuator 70 may pressurize the lubricant 68 in response to fluid pressure in an interior 76 of the outer housing 58 below the annular seal 42.

The annular seal 42 and the actuator 70 may be releasable from the outer housing 58 with the annular seal assembly 60. The drilling head 26 may include a latch assembly 44 that releasably secures the annular seal assembly 60, including the annular seal 42 and the actuator 70, in the outer housing 58, with relative rotation between the annular seal 42 and the outer housing 58 being prevented.

A method is also provided to the art by the above disclosure. In one example, the method can include positioning an annular seal 42 in a drilling head 26, the annular seal 42 including an inner liner 46 having multiple openings 54 formed through a sidewall 56 of the inner liner 46; and flowing a lubricant 68 into at least one of the openings 54 while the inner liner 46 sealingly engages a tubular 86 extending longitudinally through the inner liner 46.

The flowing step can include flowing the lubricant 68 from a lubricant reservoir 66 and through a lubricant passage 50 in the inner liner 46. The lubricant reservoir 66 and the annular seal 42 may be included in an annular seal assembly 60, and the positioning step can include releasably securing the annular seal assembly 60 in an outer housing 58 of the drilling head 26.

The method may include retrieving the annular seal assembly 60, including the annular seal 42 and the lubricant reservoir 66, from the outer housing 58.

The flowing step may include an actuator 70 pressurizing the lubricant 68 for delivery to the lubricant passage 50. The retrieving step may include retrieving the annular seal assembly 60, including the actuator 70, from the outer housing 58.

Another method described above can comprise positioning an annular seal 42 in an outer housing 58 of a drilling head 26, the annular seal 42 having a minimum inner diameter IDmin for sealing engagement with a tubular 86, and including a lubricant passage 50 extending through the annular seal 42 and intersecting an interior of the annular seal 42 at a location spaced apart from the minimum inner diameter IDmin; and flowing a lubricant 68 through the lubricant passage 50 to the interior of the annular seal 42.

The method may include rotating the tubular 86 relative to the annular seal 42, thereby conveying the lubricant 68 from the location to a contact interface between the annular seal 42 and the tubular 86 (for example, the interface between the sealing surface 52 and the exterior surface 90). The tubular 86 may include an external helical profile 88, and the conveying step may include displacing the lubricant 68 with the helical profile 88 to the contact interface.

The annular seal 42 may include an inner liner 46 surrounded by an outer body 48. The lubricant passage 50 may extend through the inner liner 46.

An annular seal assembly 60 may include the annular seal 42 and a lubricant reservoir 66, and the method may include retrieving the annular seal assembly 60, including the annular seal 42 and the lubricant reservoir 66, from the outer housing 58.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A drilling head for use with a subterranean well, the drilling head comprising:

an outer housing; and an annular seal assembly releasably secured in the outer housing, the annular seal assembly including:

at least one annular seal, and an actuator that pressurizes a lubricant for delivery to an interior of the annular seal, wherein the actuator is positioned in the annular seal assembly.

2. The drilling head of claim 1, wherein the actuator is in fluid communication with a lubricant passage extending through an inner liner of the annular seal.

3. The drilling head of claim 1, wherein the annular seal includes an inner liner surrounded by an outer body.

4. The drilling head of claim 3, wherein the inner liner comprises a plastic material, and wherein the outer body comprises an elastomeric material.

5. The drilling head of claim 3, wherein multiple openings are formed through a sidewall of the inner liner, and wherein a lubricant passage is in fluid communication with at least one of the openings.

6. The drilling head of claim 3, wherein a lubricant passage extends through the inner liner and intersects the interior of the annular seal at a location spaced apart from a minimum inner diameter of the inner liner.

7. The drilling head of claim 6, further comprising a tubular sealingly engaged by the inner liner and extending longitudinally through the inner liner, the tubular having an external helical profile adjacent the location.

8. The drilling head of claim 1, wherein the actuator comprises at least one of the group consisting of a pump and an accumulator.

9. The drilling head of claim 1, wherein the actuator pressurizes the lubricant in response to fluid pressure in an interior of the outer housing below the annular seal.

10. The drilling head of claim 1, further comprising a latch assembly that releasably secures the annular seal assembly, including the annular seal and the actuator, in the outer housing, with relative rotation between the annular seal and the outer housing being prevented.

11. A method, comprising:

positioning an annular seal in a drilling head, the annular seal including an inner liner which is configured to sealingly engage a tubular extending longitudinally through the drilling head, the inner liner having multiple openings formed through a sidewall of the inner liner, wherein at least two of the openings are circumferentially spaced apart along the sidewall;

flowing a lubricant into at least one of the openings while the inner liner sealingly engages the tubular; and the openings laterally stretching in response to radial expansion of the inner liner.

12. The method of claim 11, wherein the flowing comprises flowing the lubricant from a lubricant reservoir and through a lubricant passage in the inner liner.

13. The method of claim 12, wherein the lubricant reservoir and the annular seal are included in an annular seal assembly, and wherein the positioning comprises releasably securing the annular seal assembly in an outer housing of the drilling head.

14. The method of claim 13, further comprising retrieving the annular seal assembly, including the annular seal and the lubricant reservoir, from the outer housing.

15. The method of claim 14, wherein the flowing further comprises an actuator pressurizing the lubricant for delivery to the lubricant passage, and wherein the retrieving comprises retrieving the annular seal assembly, including the actuator, from the outer housing.

16. A method, comprising:

positioning an annular seal in an outer housing of a drilling head, the annular seal having a minimum inner diameter for sealing engagement with a tubular, and including a lubricant passage extending through the annular seal and intersecting an interior of the annular seal at a location spaced apart from the minimum inner diameter;

flowing a lubricant through the lubricant passage to the interior of the annular seal; and rotating the tubular relative to the annular seal, thereby conveying the lubricant from the location to a contact interface between the annular seal and the tubular, wherein the tubular includes an external helical profile, and wherein the conveying comprises displacing the lubricant with the helical profile to the contact interface.

17. The method of claim 16, wherein the annular seal comprises an inner liner surrounded by an outer body, and wherein the lubricant passage extends through the inner liner.

18. The method of claim 16, wherein an annular seal assembly includes the annular seal and a lubricant reservoir, and further comprising retrieving the annular seal assembly, including the annular seal and the lubricant reservoir, from the outer housing.

* * * * *